US012529509B2

(12) United States Patent
Pizzi et al.

(10) Patent No.: US 12,529,509 B2
(45) Date of Patent: Jan. 20, 2026

(54) GASKET FOR REFRIGERATED CABINET

(71) Applicant: True Manufacturing Co., Inc., O'Fallon, MO (US)

(72) Inventors: Christian Pizzi, O'Fallon, MO (US); Christopher Moonier, O'Fallon, MO (US); Brandon Clay, O'Fallon, MO (US); John Friend, O'Fallon, MO (US)

(73) Assignee: TRUE MANUFACTURING CO., INC., O'Fallon, MO (US)

( * ) Notice: Subject to any disclaimer, the term of this patent is extended or adjusted under 35 U.S.C. 154(b) by 92 days.

(21) Appl. No.: 18/401,859

(22) Filed: Jan. 2, 2024

(65) Prior Publication Data

US 2024/0219108 A1 Jul. 4, 2024

Related U.S. Application Data

(63) Continuation of application No. PCT/US2023/086456, filed on Dec. 29, 2023.

(60) Provisional application No. 63/477,949, filed on Dec. 30, 2022.

(51) Int. Cl.
*F25D 23/08* (2006.01)

(52) U.S. Cl.
CPC ..... *F25D 23/087* (2013.01)

(58) Field of Classification Search
CPC ..... F25D 23/087
USPC ..... 312/296
See application file for complete search history.

(56) References Cited

U.S. PATENT DOCUMENTS

| | | | | |
|---|---|---|---|---|
| 8,944,539 | B2 * | 2/2015 | Ramm | E06B 7/2303 312/405 |
| 2003/0222553 | A1 * | 12/2003 | Lee | F25D 23/087 312/405 |
| 2005/0110375 | A1 * | 5/2005 | Lim | F25D 23/087 312/296 |
| 2006/0188690 | A1 * | 8/2006 | Jun | F25D 23/087 428/99 |

(Continued)

FOREIGN PATENT DOCUMENTS

| | | |
|---|---|---|
| CN | 103411374 A | 11/2013 |
| CN | 106016929 A | 10/2016 |
| CN | 107990622 A | 5/2018 |

OTHER PUBLICATIONS

International Search Report and Written Opinion from PCT/US23/86456, dated May 29, 2024, 15 pages.

*Primary Examiner* — Daniel J Rohrhoff
(74) *Attorney, Agent, or Firm* — Stinson LLP

(57) ABSTRACT

A gasket for a door of a refrigerated cabinet has a bellows chamber extending backward from a base connected to a door. A magnet chamber is supported on the bellows chamber, and a cantilevered arm extends from the inner side of the magnet chamber. The cantilevered arm includes a proximal middle chamber, a distal sealing bulb chamber, and a partition wall between the middle chamber and the sealing bulb chamber. A condensation shield is outward of an outer bellows chamber wall and extends from the base to the magnet chamber. An inner support chamber is received between the bellows chamber and a profiled section of the door. A wiper extends forward from the inner support chamber. The sealing bulb chamber is configured to be pressed backward against the wiper such that the gasket defines a supplemental chamber when the door is closed.

21 Claims, 15 Drawing Sheets

(56) References Cited

U.S. PATENT DOCUMENTS

| | | | | |
|---|---|---|---|---|
| 2007/0084125 | A1* | 4/2007 | Gholap | F25D 23/087 49/478.1 |
| 2009/0277096 | A1* | 11/2009 | Ramos | F25D 23/087 49/478.1 |
| 2018/0073800 | A1* | 3/2018 | Okazaki | F25D 23/08 |
| 2018/0372396 | A1* | 12/2018 | Willert | E06B 7/2305 |
| 2019/0128591 | A1* | 5/2019 | Visin | F25D 23/02 |
| 2020/0011590 | A1* | 1/2020 | Johnson | E06B 7/2309 |
| 2021/0032929 | A1* | 2/2021 | Raab | F25D 23/028 |
| 2021/0172674 | A1* | 6/2021 | Basarir | E05C 19/161 |
| 2021/0404736 | A1* | 12/2021 | Caglin | F25D 23/087 |
| 2023/0251026 | A1* | 8/2023 | Chhajed | F25D 23/087 312/406 |
| 2024/0219107 | A1* | 7/2024 | Pizzi | F25D 23/062 |

* cited by examiner

GASKET FOR REFRIGERATED CABINET

CROSS-REFERENCE TO RELATED APPLICATIONS

This patent application is a continuation of International PCT Application No. PCT/US2023/86456 and claims the benefit of U.S. Provisional Patent Application No. 63/477,949, filed Dec. 30, 2022, which is hereby incorporated by reference in its entirety for all purposes.

FIELD

This disclosure generally pertains to a refrigerated cabinet, more particularly a refrigerated cabinet that is configured to achieve sub-freezing internal temperatures at a range of ambient conditions without condensation forming on the cabinet.

BACKGROUND

A known problem in the field of refrigerated cabinets is condensation forming on metal exterior surfaces. Condensation forms when metal exterior surfaces are cooled below the ambient dew point temperature. This commonly occurs near the cabinet's door frame, where there is usually some degree of thermal communication with the chilled interior of the cabinet. Various strategies have been employed to mitigate condensation near the door frame. For example, it is common to provide a non-metal thermal break along the door frame between a metal exterior cabinet wrapper and the internal liner. It is also common to use door frame heaters to keep the temperature of the door frame elevated above the dew point. The inventors believe it is possible to improve on prior efforts to mitigate condensation near refrigerated cabinet door frames.

SUMMARY

In one aspect, a gasket for a door of a refrigerated cabinet comprises a base configured to be supported on the door along the perimeter edge margin of the door so that the gasket faces backward from the door for sealing with a door frame of the refrigerated cabinet when the door is closed. A bellows chamber has a front end connected to the base and an opposite rear end. A magnet chamber is supported on the rear end of the bellows chamber. The magnet chamber has an inner side and an outer side. A magnet is received in the magnet chamber. A cantilevered arm is cantilevered from the inner side of the magnet chamber. The cantilevered arm includes a proximal middle chamber, a distal sealing bulb chamber, and a partition wall between the middle chamber and the sealing bulb chamber.

In another aspect, a gasket for a door of a refrigerated cabinet comprises a base configured to be supported on the door and a magnet chamber. A magnet is received in the magnet chamber. A bellows chamber connects the magnet chamber to the base. The bellows chamber comprises an outer bellows wall having a front end connected to the base and a rear end connected to the magnet chamber. A condensation shield is spaced apart outwardly of the outer bellows wall and extends from the base to the magnet chamber for shielding the outer bellows wall from exposure to ambient atmosphere.

In another aspect, a gasket for a door of a refrigerated cabinet comprises a base configured to be supported on the door. A bellows chamber has a front end connected to the base and an opposite rear end. A magnet chamber is supported on the rear end of the bellows chamber. The magnet chamber has an inner side and an outer side. A magnet is received in the magnet chamber. A sealing bulb chamber is cantilevered from the inner side of the magnet chamber. The sealing bulb chamber is configured to be compressed between a door frame of the refrigerated cabinet and a profiled section of the door when the door is closed. An inner support chamber adjacent the bellows chamber is configured to be received between the bellows chamber and the profiled section of the door. A wiper extends forward from the inner support chamber. The sealing bulb chamber is configured to be pressed backward against the wiper such that the gasket defines a supplemental chamber when the door is closed. The wiper, the sealing bulb chamber, and the inner support chamber define portions of the supplemental chamber.

Other aspects and features will be apparent hereinafter.

BRIEF DESCRIPTION OF THE DRAWINGS

Corresponding parts are given corresponding reference characters throughout the drawings.

DETAILED DESCRIPTION

Figure 1:
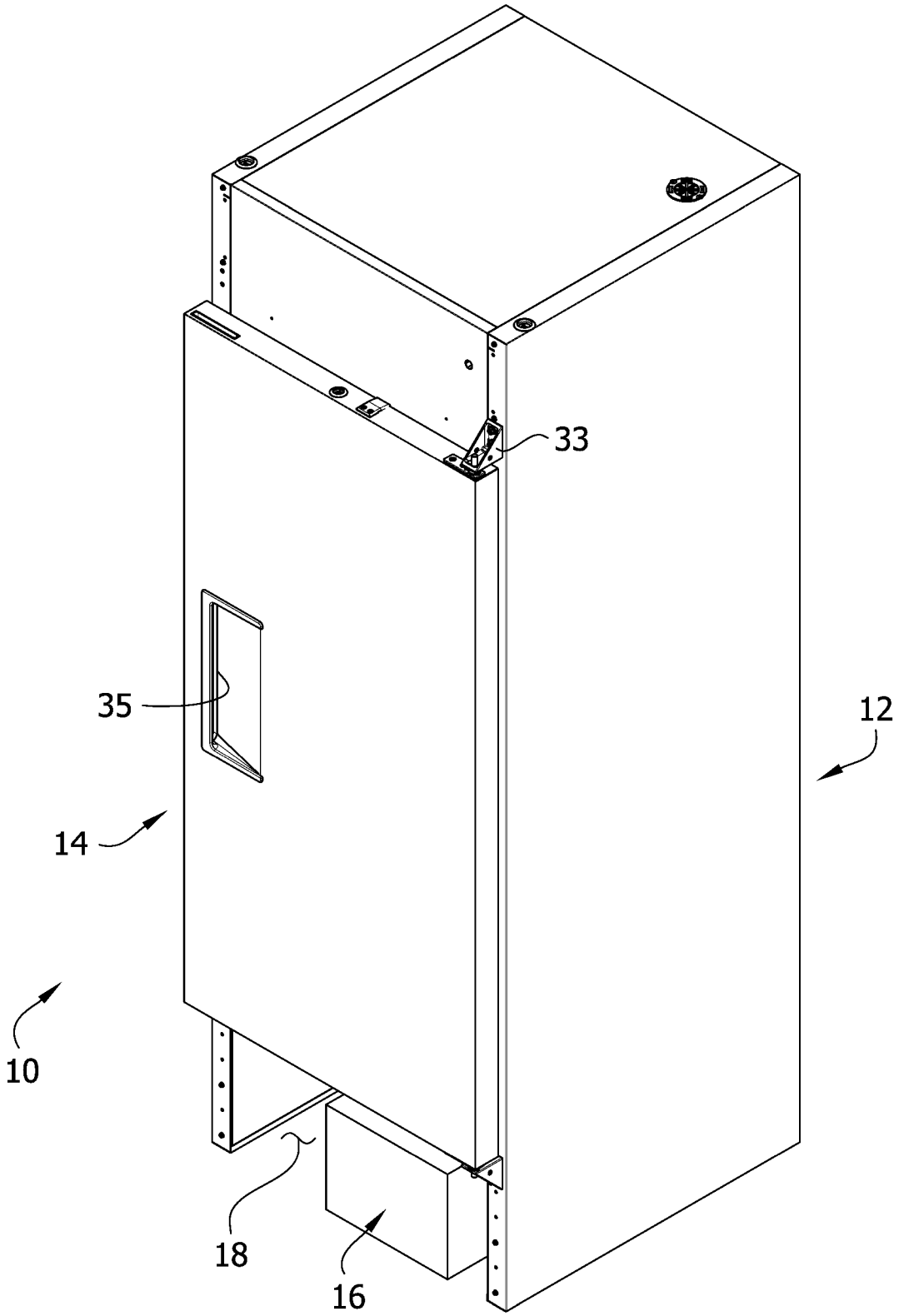
FIG. 1 is a perspective of a refrigerated cabinet.
Figure 2:
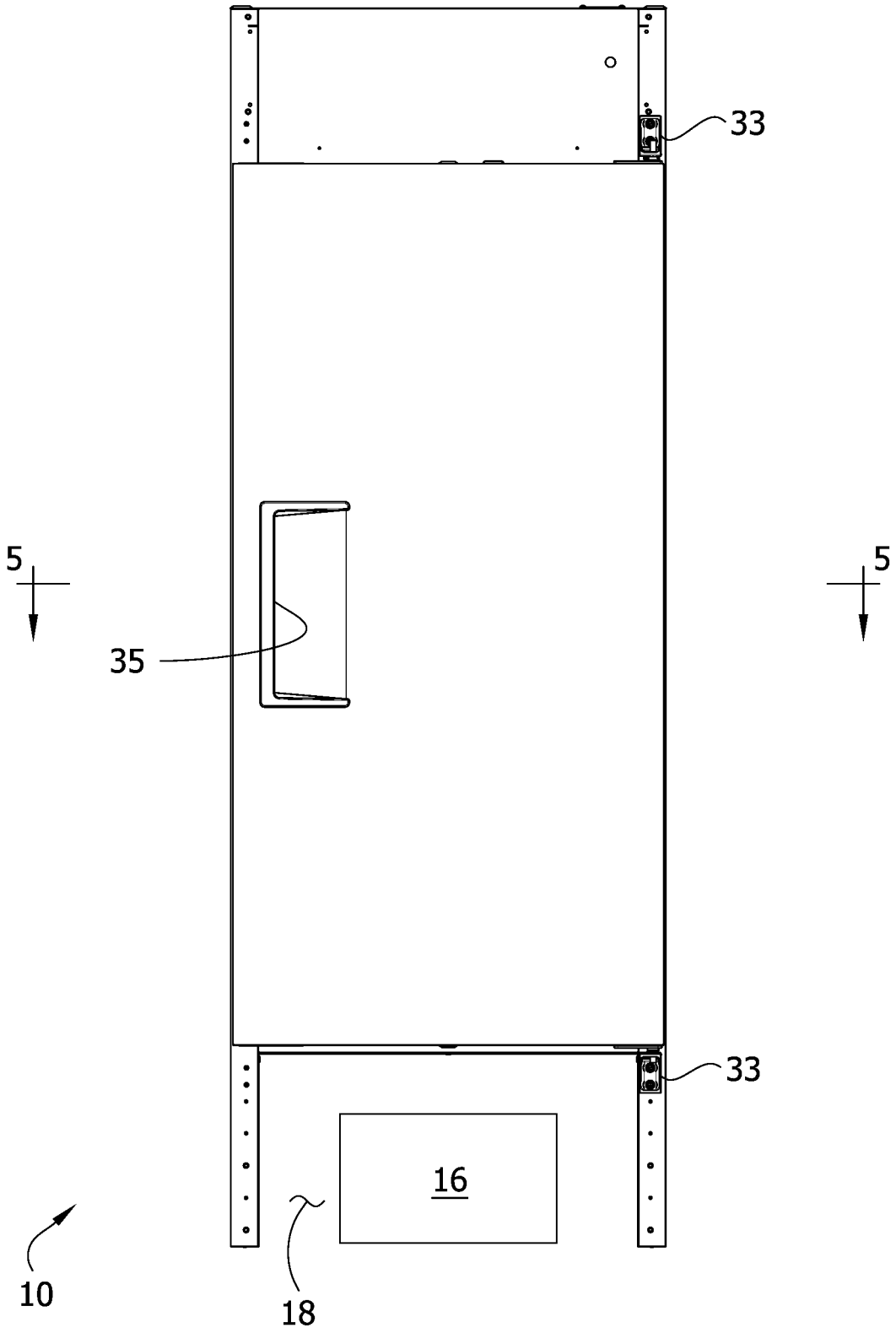
FIG. 2 is a front elevation of the refrigerated cabinet.
Figure 3:
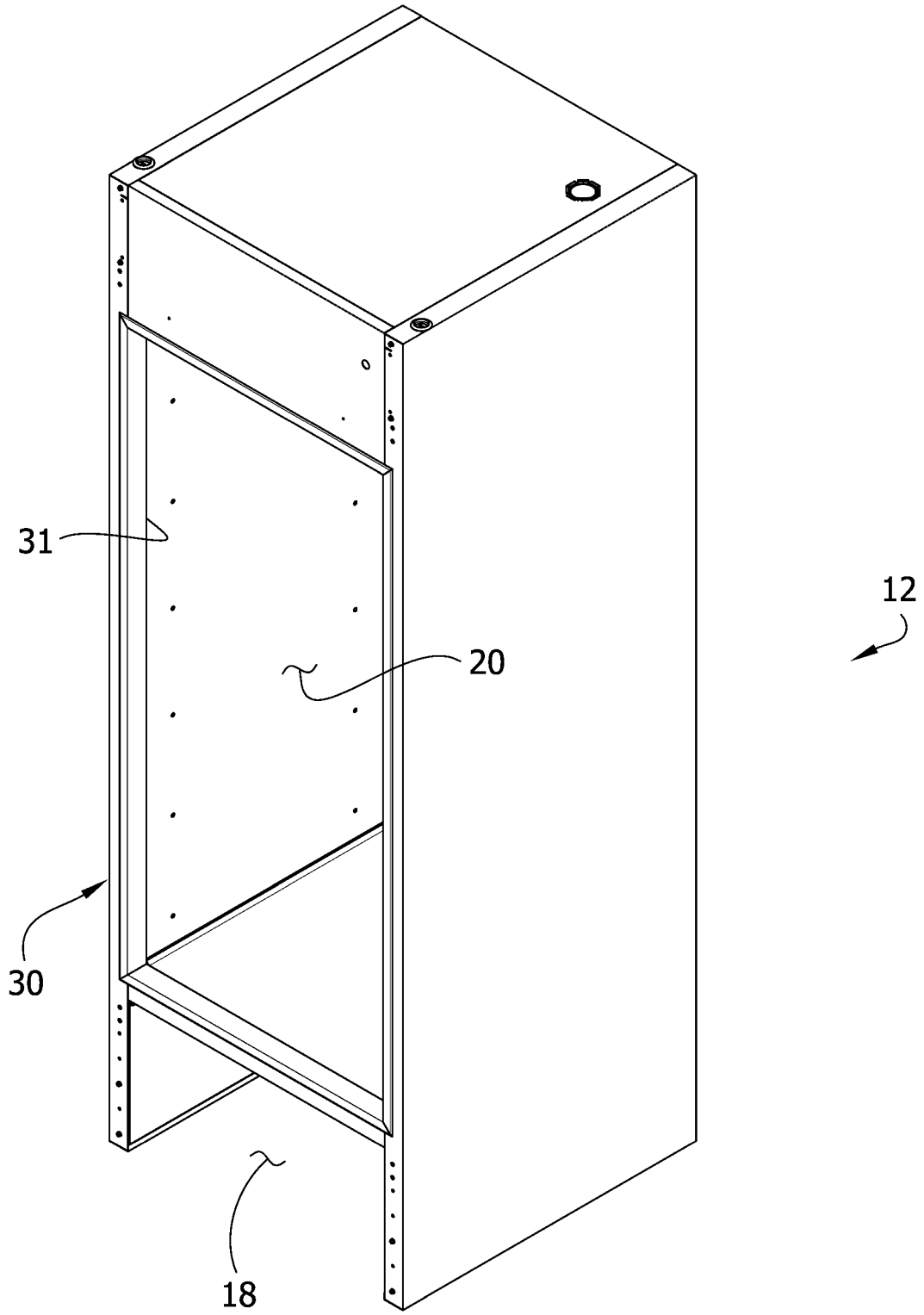
FIG. 3 is a perspective of a cabinet body of the refrigerated cabinet.
Figure 4:
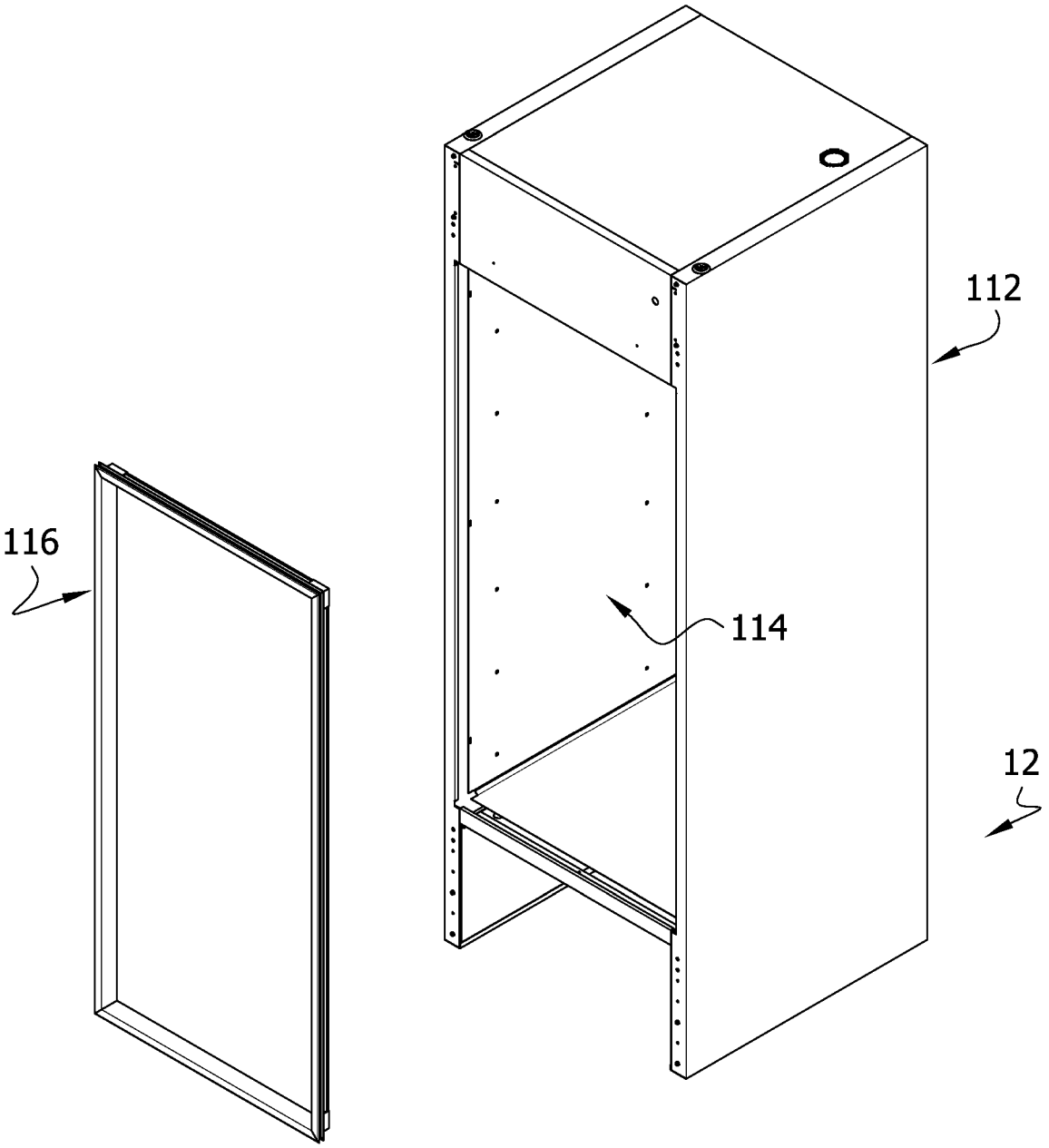
FIG. 4 is an exploded perspective of the cabinet body.

Throughout this disclosure the terms forward, backward, front, back, rear, etc., assume a frame of reference in which the door is the front side of refrigerated cabinet and there is a back wall opposite the door. This disclosure frequently uses terms like inner, outer, inward, outward, inboard, and outboard to describe the relative positions and orientations of components shown in cross section. The frame of reference for understanding such terms is in relation to the interior and exterior of the cabinet and doorframe. Cross-sectional features closer to the interior of the cabinet or doorframe are referred to as inner components as compared with cross-sectional features closer to the exterior of the cabinet or door frame, which are referred to as outer components.

Referring to FIGS. 1-7, an exemplary embodiment of a refrigerated cabinet is generally indicated at reference number 10. The refrigerated cabinet 10 comprises a cabinet body 12, a door 14, and a refrigeration system for cooling the refrigerated cabinet, shown schematically at reference number 16. In certain embodiments, the refrigeration system 16 is configured to maintain sub-freezing set point temperatures inside the cabinet body 12, such as set point temperatures of −10° F. (−23° C.) or less or set point temperatures of −20° F. (−29° C.) or less. As explained more fully below, the refrigerated cabinet 10 is specially constructed to mitigate against condensation on exterior surfaces of the cabinet body 12, even in challenging ambient conditions with relatively high dew point temperatures.

Various refrigeration systems can be used in refrigerated cabinets in the scope of this disclosure. In one or more embodiments the refrigeration system 16 comprises a complete compression-driven refrigeration circuit including an evaporator unit, a compressor, a condenser unit, a drier, an expansion device, and interconnecting tubing. Those skilled in the art will be familiar with the basic components, functions, and operations of these components in a compression-driven refrigeration circuit. In the illustrated embodiment, the refrigerated cabinet 10 is configured to receive the condenser unit and compressor in a lower mechanical compartment 18 of the cabinet body 12. The cabinet body 12 comprises a refrigerated interior 20 above the mechanical compartment 18. The evaporator unit of the refrigeration system is optionally located in an upper section of the interior 20 above the door for cooling the interior of the cabinet. It will be understood that compression-driven refrigeration systems can have other arrangements (e.g., top-mounted condenser units, evaporator units in the lower section or back section of the cabinet, etc.) without departing from the scope of the disclosure.

In the illustrated embodiment, the refrigerated cabinet 10 is a single-door cabinet, but it will be understood that other door configurations are also possible without departing from the scope of the disclosure. The cabinet body 12 has a door frame 30 defining a doorway 31 for providing access to the interior 20. The door 14 is connected to the cabinet body 12 for movement in relation to the cabinet body between an opened position (not shown) in which the door is clear of the doorway 31 for providing access to the interior 20 through the doorway and a closed position (FIG. 1) in which the door is supported against the door frame 30 and covers the doorway. The illustrated door 14 is a hinged door 14 configured to couple to the cabinet at hinges 33 for rotating about the hinges between the closed position and the open position. The illustrated door 14 comprises a recessed handle 35 opposite the hinges 33.

Figure 5:
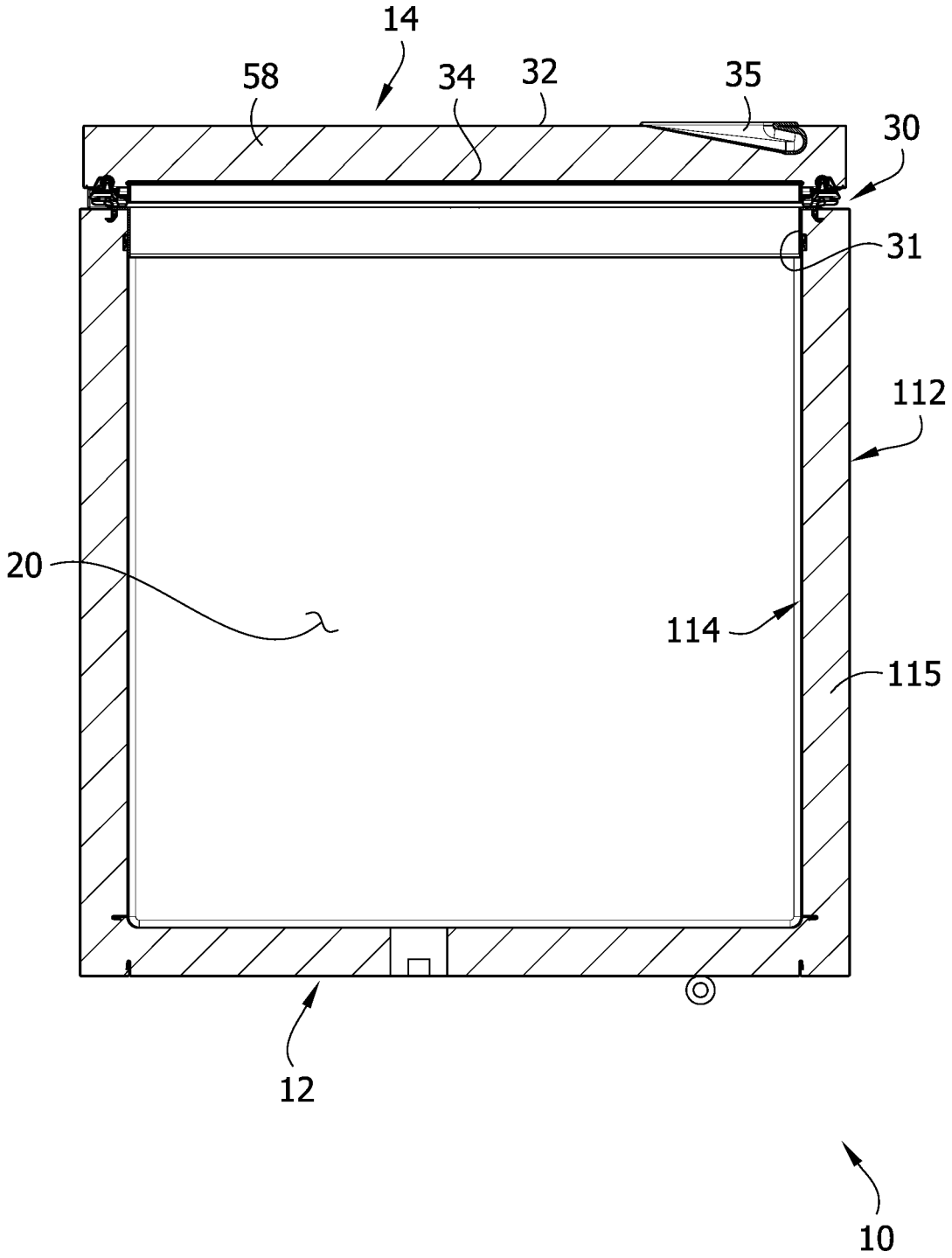
FIG. 5 is a cross section taken in the plane of line 5-5 of FIG. 2.
Figure 6:
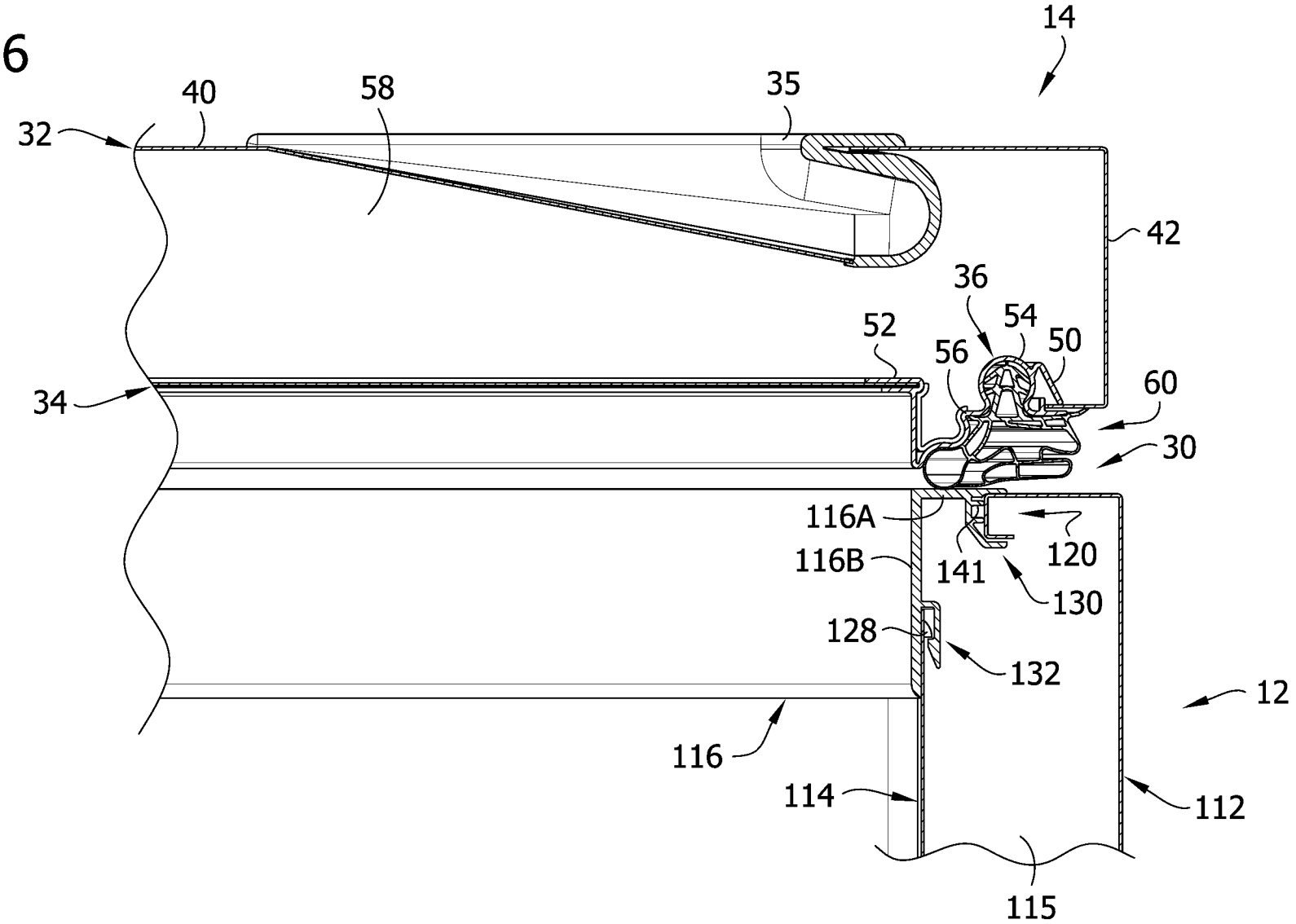
FIG. 6 is an enlarged fragmentary view of a portion of FIG. 5.
Figure 7:
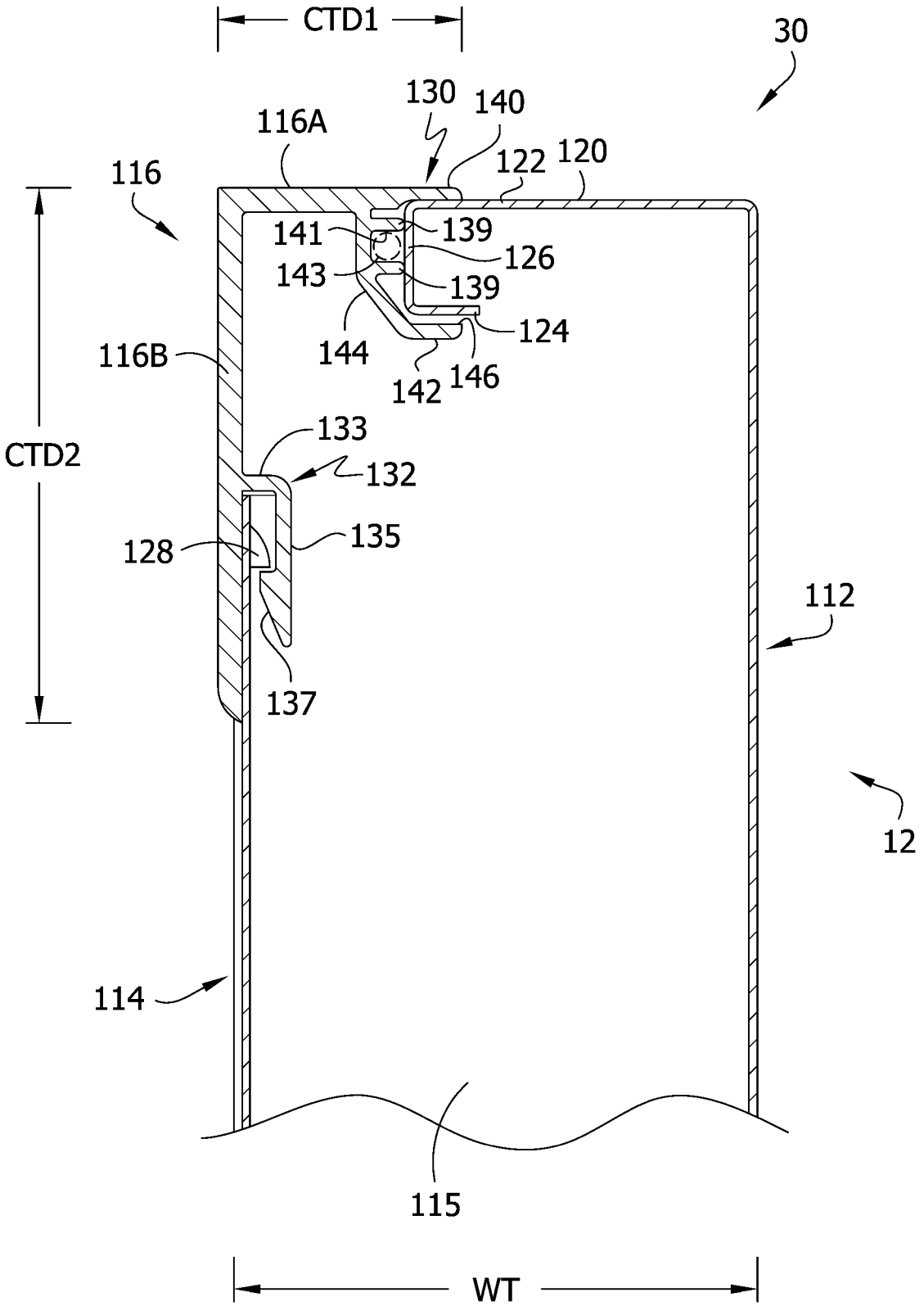
FIG. 7 is a further enlarged fragmentary cross section of a portion of a door frame of the cabinet body.

Referring to FIGS. 5-7, this disclosure now turns to details about the construction of the door 14 and the door frame 30. FIGS. 5-7 show a cross section of the refrigerated cabinet 10 in the plane of line 5-5 of FIG. 2. With the exception of the door handle 35, the major features of the perimeter portion of the door 14 and door frame 31 shown in cross-section in FIGS. 5-7 are essentially the same around the entire perimeter of the door and door frame.

The illustrated door 14 is formed from a door wrapper 32, a door liner 34, and a thermal breaker 36 that couples the door wrapper to the door liner and provides a thermal break between the door wrapper and the door liner. The door liner 36 is exposed to the interior 20 of the cabinet 10 when the door 14 is closed, and the door wrapper 32 is exposed to the exterior of the cabinet when the door is closed. The door wrapper 32 comprises a front panel 40 and double return sides 42 extending around the perimeter of the door. The rear sections of the double return sides 42 include an inner perimeter edge margin at which the wrapper 32 is configured to couple to the thermal breaker 36. The illustrated door liner 34 is substantially planar and includes an outer perimeter edge margin at which the liner is configured to couple to the thermal breaker 36.

The thermal breaker 36 comprises an outer interface 50 configured to couple to the perimeter edge margin of the wrapper 32. More particularly, the outer interface 50 comprises an outwardly opening channel that is configured to receive the inner perimeter edge margin of the wrapper 32. Similarly, the thermal breaker 36 comprises an inner interface 52 configured to couple to the perimeter edge margin of the liner 34, specifically an inwardly opening channel configured to receive the perimeter edge margin of the liner. The door thermal breaker 32 further comprises a gasket mounting feature 54 for mounting a door gasket 60 on the door. In the illustrated embodiment, the gasket mounting feature 54 comprises a channel that opens rearward for receiving a mounting dart 62 of the door gasket. The door thermal breaker 36 further comprises an inner profiled section 56 defining an outwardly facing surface that generally matches opposing surfaces of the inner portion of the door gasket 60 so that the profiled section is configured to provide conforming support for the inner portion of the door gasket.

The door wrapper 32, the door liner 34, and the thermal breaker 36 enclose an insulated interior 58 of the door 14. In the illustrated embodiment, the interior 58 is filled with foam insulation.

Figure 10:
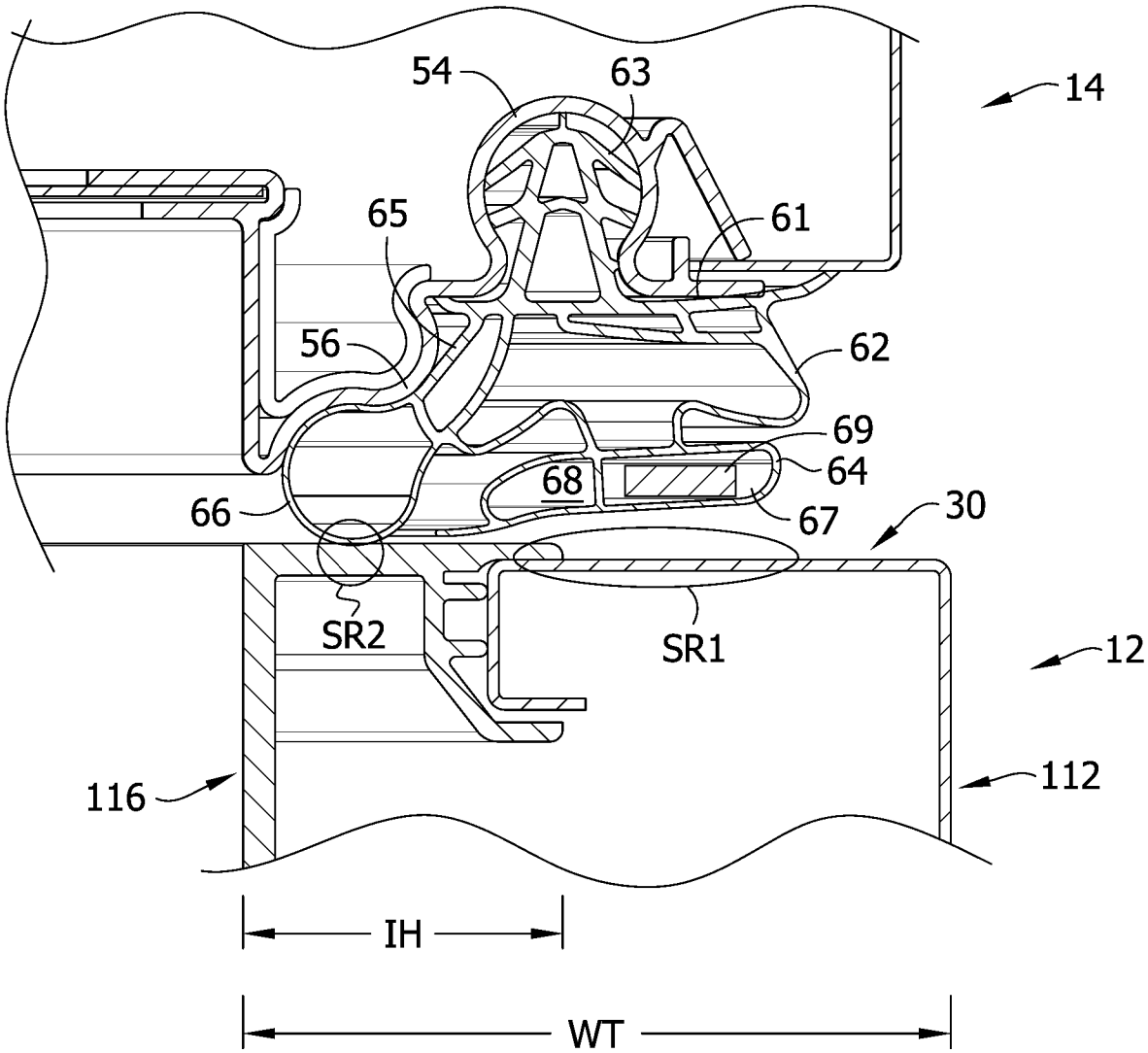
FIG. 10 is a further enlarged fragmentary view of a portion of FIG. 6.

Referring to FIG. 10, in the illustrated embodiment, the gasket 60 is a refrigeration gasket available from Ilpea Industries. In cross-section, the gasket comprises a relatively rigid base 61, a mounting dart 63 extending forward from the base and snap fit into the mounting channel 54, a flexible bellows 62 extending backward from the base, an outer sealing element 64 on the back end of the bellows, a relatively rigid base extension 65 extending backward from the inner end of the base inboard of the bellows and contacting the inner profiled section 56 of the door 14, and an inner sealing element 66 on the rear end of the base extension 65. The outer sealing element 64 is configured to make a magnetic seal with the door frame 30 at an outer seal region SR1. The outer sealing element 64 comprises a magnet chamber 67 and an empty chamber extending inward from the magnet chamber. A magnet 69 is received in the magnet chamber 67. When the door 14 is closed, the magnet 69 is configured to magnetically adhere the outer sealing element 64 against the forward facing surface of the door frame 30. (FIG. 10 shows the position of the gasket 60 immediately before the magnet 69 draws the gasket into sealing contact with the door frame 30). The inner sealing element 66 is configured to make a second seal with the door frame 30 at an inner seal region SR2 that is spaced apart inwardly of the outer seal region SR1. The inner sealing element 66 does not rely on magnetic attraction for close contact with the door frame. Rather, the inner profiled section 56 of the door 14 is shaped and arranged to hold and support the inner sealing element 66 so that it is compressed against the forward facing surface of the door frame 30 when the door 14 is closed.

Referring to FIGS. 5-10, the cabinet body 12 comprises an outer wrapper 112 and an inner liner 114. In one or more embodiments, both the outer wrapper 112 and the inner liner 114 are formed from sheet metal, such as stainless steel sheet metal. The inner liner 114 defines the bottom, top, left side, right side, and back of the refrigerated interior 20. The outer wrapper 112 is configured to be disposed around the outside of the inner liner 114 so that an insulation space 115 is defined between the liner and the wrapper about refrigerated interior. The insulation space 115 is suitably filled with foam insulation (e.g., sprayed-in polyurethane foam insulation). Various ways of forming sheet metal liners and wrappers are known to those skilled in the art, and any suitable way can be used without departing from the scope of the disclosure. The wrapper 112 and the liner 114 are arranged so that the cabinet has a wall thickness WT extending inward from a major panel of the wrapper to an opposing major panel of the liner. In one or more embodiments the wall thickness WT is in an inclusive range of from 1.125 inches (2.9 cm) to 3.375 inches (8.6 cm) (e.g., an inclusive range of from 1.125 inches (2.9 cm) to 3.125 inches (7.9 cm), or an inclusive range of from 1.5 inches (3.8 cm) to 2.5 inches (6.4 cm)). In certain exemplary embodiments in the scope of the invention, the wall thickness WT is less than or equal to 3.0 inches (7.6 cm) (e.g., less than or equal to 2.5 inches (6.4 cm), less than or equal to 2.0 inches (5.1 cm), less than or equal to 1.8 inches (4.6 cm), or less than or equal to 1.75 inches (4.4 cm)).

The wrapper 112 and the liner 114 each have a respective front edge margin adjacent the doorway 31. The front edge margin of each of the wrapper 112 and the liner 114 extends 360° about the perimeter of the doorway 31. The front edge margins of the wrapper 112 and the liner 114 are spaced apart from one another. A plastic thermal breaker 116 is placed between the front edge margin of the wrapper 112 and the front edge margin of the liner 114 to connect the liner to the wrapper and provide a thermal break between the liner and the wrapper.

In the illustrated embodiment, the front edge margin of the wrapper 112 comprises a double return flange 120 comprising a front section 122, an opposite back section 124, and an inner section 126 extending from the front section to the back section. The front section 122 extends inward from the front corner of the door frame 30 to an inner/front corner of the double return flange 120 where the front section meets the inner section 126. The outer portion of the front section 122 is exposed on the front of the door frame 30 and thus defines a forward-facing surface of the door frame. The inner portion of the front section 122 is covered by the thermal breaker 116, as described in further detail below. Both the front section 122 and the back section 124 extend outward from respective corners where they meet the inner section 126. The back section 126 defines the terminal edge of the double return flange 120.

Figure 8:
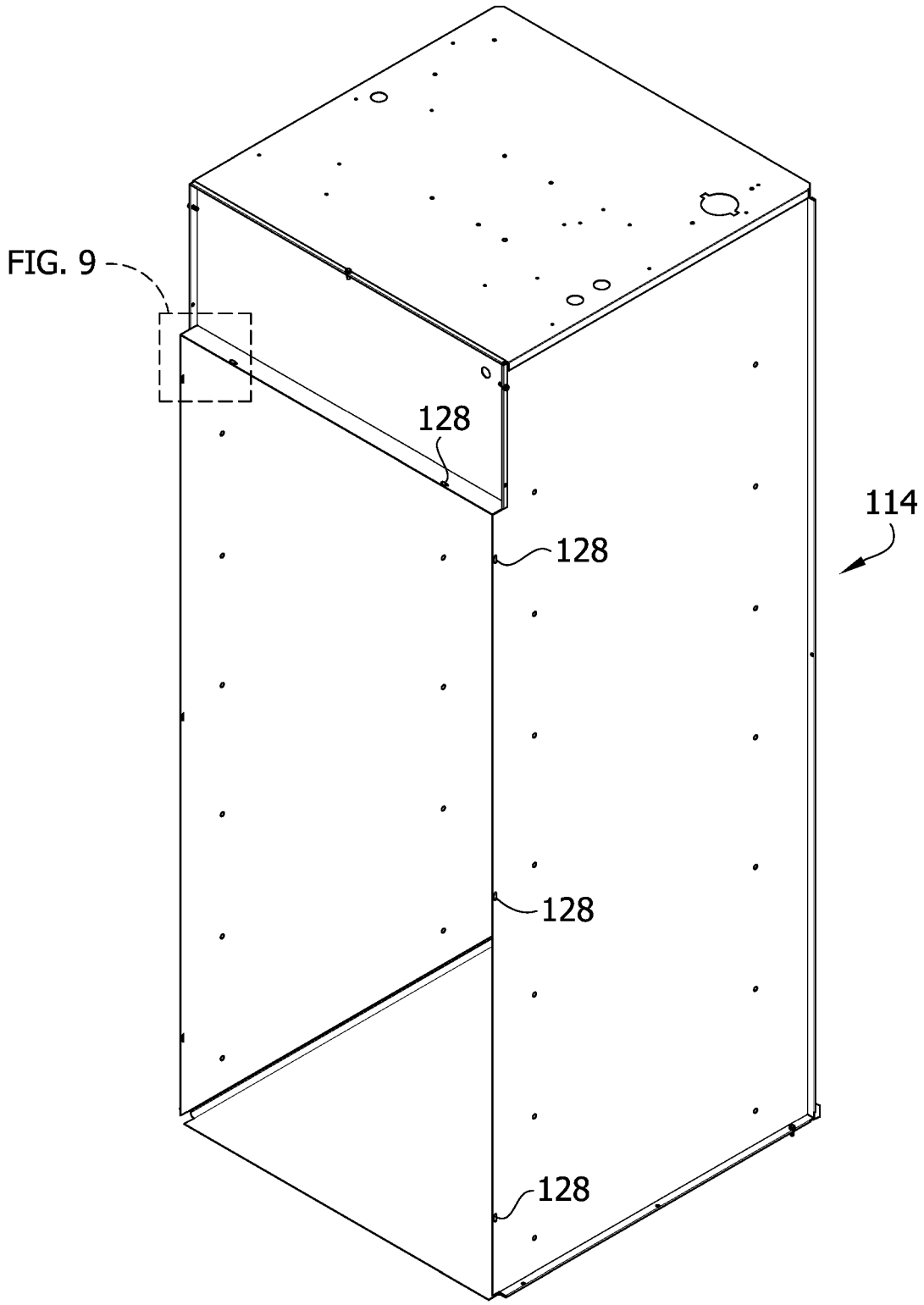
FIG. 8 is a perspective of a liner of the cabinet body.
Figure 9:
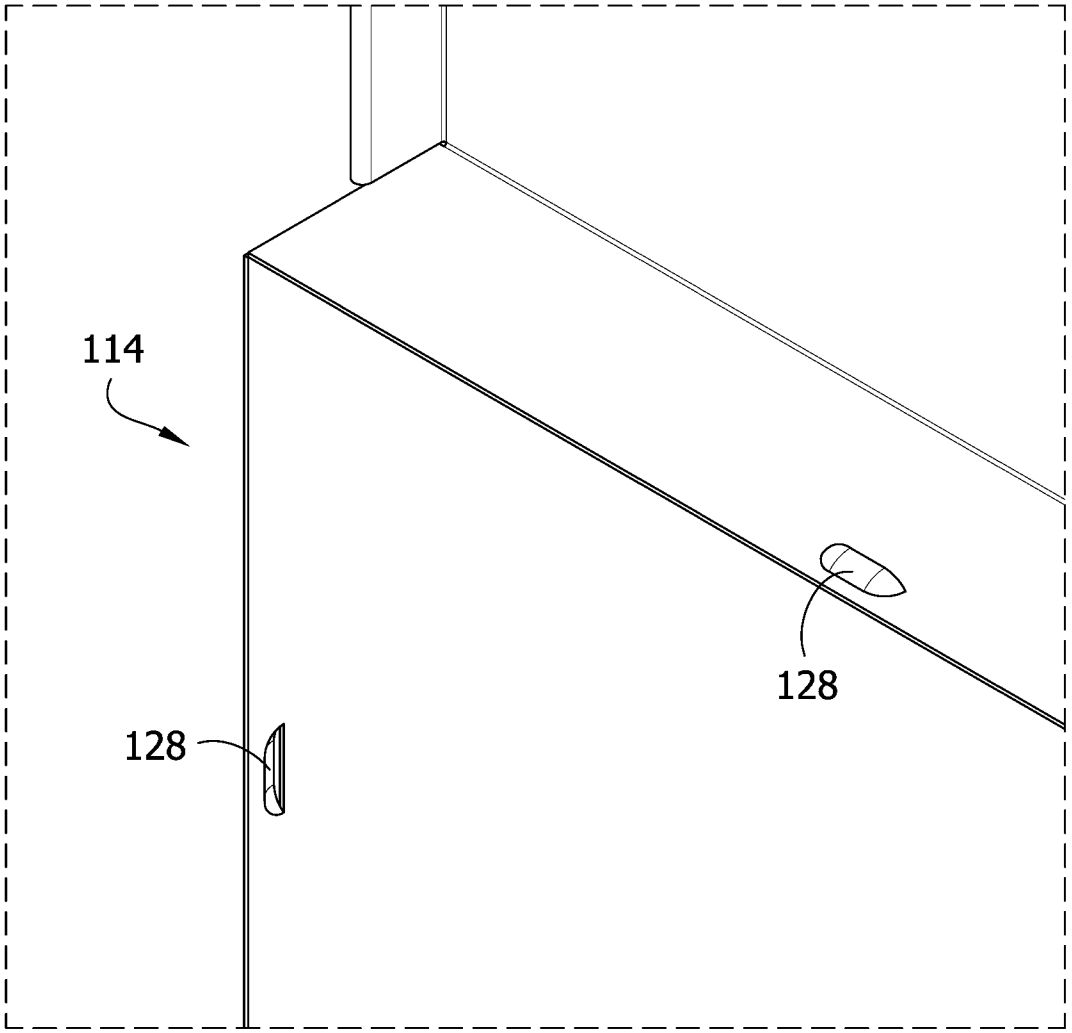
FIG. 9 is an enlarged view of a portion of FIG. 8.

Referring to FIGS. 8-9, the front edge margin of the liner 114 comprises a plurality of protrusions 128 spaced apart around the perimeter. Suitably, the front edge margin of the liner 114 comprises a plurality of protrusions 128 along each of at least the top, left and right sides of the front edge margin. In the illustrated embodiment, each protrusion 128 is formed by making a cut in the sheet metal parallel to the front edge and bending a section of the sheet metal immediately in front of the cut outward to form the protrusion. This defines protrusions 128 with tapered front end portions and back edges perpendicular to the major plane of the sheet metal.

In the illustrated embodiment, the thermal breaker 116 is a four-piece frame assembly. That is, the thermal breaker 116 comprises a top piece, a bottom piece, a left piece, and a right piece, joined together at four corners. Suitably, each of the four pieces is cut from the same type of plastic extrusion. Each of the four pieces of the thermal breaker 116 has the same cross-sectional shape. In one or more embodiments, the four thermal breaker pieces come together at miter joints. But it will be understood that other types of corner joinery can also be used without departing from the scope of the disclosure.

The thermal breaker 116 has a generally L-shaped cross-sectional shape including a front/outer section 116A that defines a forward facing door frame surface and a rear/inner section 116B generally perpendicular to the front/outer section. The rear/inner section 116B defines the doorway 31 of the refrigerated cabinet 10. The front/outer section 116A and the rear/inner section 116B meet at a corner and extend outward in perpendicular directions to respective tips. The front/outer section 116A has a first corner-to-tip dimension CTD1 that extends substantially parallel to the cabinet body wall thickness WT, and the rear/inner section has a second corner-to-tip dimension CTD2 that extends perpendicular to the first corner-to-tip dimensions CTD1 in a front-to-back direction of the refrigerated cabinet 10. In the illustrated embodiment, the second corner-to-tip dimension CTD2 is greater than the first corner-to-tip dimension CTD1. In an exemplary embodiment, the second corner-to-tip dimension CTD2 is at least 1.5-times the first corner-to-tip dimension CTD1 (e.g., the second corner-to-tip dimension CTD2 is at least twice the first corner-to-tip dimension CTD1).

The front/outer section 116A defines an outer interface 130 connected to the double return flange 120 of the wrapper 112, and the rear/inner section defines an inner interface 132 connected to the front edge margin of the liner 114. The inner interface 132 comprises a channel configured to receive the front edge margin of the liner 114 and to engage the plurality of protrusions 128 by snap fit. The channel 132 comprises an L-shaped (in cross section) extension that includes a short proximal segment 133 extending outward from the main part of the rear/inner section 116B and a longer distal segment 135 that extends rearward from the proximal segment, opposite the rear end of the main part of the rear/inner section. The distal segment 135 comprises an inwardly protruding latch hook 137. To couple the liner 114 to the thermal breaker 116, the front edge margin of the liner is inserted forwardly into the open rear end of the channel 132. The tapered front end portions of the protrusions 128 engage the leading inner ramp surface of the latch hook 137 as a wedge and thereby bend the distal segment 135 of the channel 132 outward. Upon further insertion, the protrusions 128 will clear the latch hook 137. The latch hook 137 snaps over the back edges of the protrusions to secure the front edge margin of the liner 114 in the channel 132.

The outer interface 130 comprises a channel configured to receive the double return flange 120. The outer channel 130 has a wider opening than the inner channel 132. The channel 130 has a front section 140, a back section 142, an inner section 144 extending from the front section to the back section, and an open outer end 146 opposite the inner section extending between the front section and the back section. The open outer end 146 is shaped and arranged so that the double return flange 120 of the wrapper 112 can be inserted inward into the channel 130 through the open outer end 146. The double return flange 120 can be temporarily secured in the channel 130 by tape during foaming of the insulation cavity 115. After the cavity 115 is foamed, the cured foam securely locks the double return flange 120 in the channel 130.

In the illustrated embodiment, the inner section 144 includes a front segment extending perpendicularly rearward from the main part of the front/outer section 116A, and a rear segment that extends rearward and outward at an angle from the front segment to the back section 142. The outer channel 130 further comprises first and second interior legs 139 (FIG. 7) extending outward perpendicularly from the front segment of the inner section 144 to define a heating element duct 141. The outer ends of the legs 139 of the heating element duct 141 are configured to engage the inner section 126 of the double return flange 120 to support the double return flange in the outer channel 130. In addition, the legs 139 are arranged so that the heating element duct 141 is configured to receive an optional frame heater 143 (e.g., a resistance heating wire or hot gas loop tubing). The channel 130 is configured to hold the frame heater 143 in thermal communication with the front edge margin of the wrapper, e.g., by pressing the heater against the inner section 126 of the double return flange 120. The door frame 30 is free of metal material in front of the heating element duct 141. Only plastic material is in front of the heating element duct 141.

Referring to FIGS. 12-15, in certain embodiments the thermal breaker 116 can comprise corner joiner elements 150 at each of the four corners of the door frame. The corner joiner elements 150 are generally configured for joining the four pieces of the thermal breaker 116 at the corners of the thermal breaker. In the illustrated embodiment, the corner joiner element 150 comprises a L-shaped thermoplastic plate (suitably, the thermal breaker pieces 116 are also formed of thermoplastic material). At each corner of the thermal breaker 116, one of the L-shaped plates 150 is received in the gap 152 between the channel section 144 and the rear/inner section 116B. As explained above, the individual pieces of the thermal breaker 116 meet at mitered corner. Each plate 150 is received in the gaps 152 of the two thermal breaker pieces defining the mitered corner so that a first section of the plate engages against the front/outer section 116A of a first thermal breaker piece and a second section of the plate engages the front/outer section 116A of a second thermal breaker. The illustrated corner joiner elements 116 comprise a plurality of forward-facing energy directors 154 spaced apart along the first and second sections of the plate. Each energy director 154 is small conical protrusion on the front side of the plate. The secure each corner of the thermal breaker 116, the plate is pressed forward in the gap 152 against the front/outer sections 116A. Then the manufacturer uses an ultrasonic welding system to impart ultrasonic energy. The energy is directed to the interface between the plate 116 and the front/outer sections 116A where it creates sufficient heat to weld the plate to the two thermal breaker pieces, thereby firmly joining the two thermal breaker pieces at the corner.

Referring again to FIG. 10, it can be seen that the door frame 30 of the cabinet body 12 is designed so that the inner sealing element 66 of the gasket 60 is configured to seal against the forward facing surface of the thermal breaker 116 and the outer sealing element 64 is configured to seal against the forward facing surface of the wrapper 112. The door frame 30 and the door 14 are arranged with respect to one another so that the gasket magnet 69 aligns with the exposed forward facing surface of the wrapper. In the illustrated embodiment, this is achieved by configuring the thermal breaker 116 so that the front part of the front/outer section is located entirely on the inner half IH of the wall thickness T of the cabinet body 12. Thus, the plastic material on the front face of the door frame 30 is only located on the inner half IH of the door frame thickness WT. The outer half of the front face of the door frame 30 is entirely metal, and in this case, formed by the wrapper 112.

Preferably, the wrapper 112 is formed from ferromagnetic material so that the magnet 69 of the outer sealing element 64 is magnetically attracted to the front section of the wrapper without inclusion of any other magnetic materials in the door frame 30. In certain embodiments, however, it is conceivable to use a non-magnetic metal for the wrapper and to add a magnetic or ferromagnetic strip in the door frame along the front section of the double return flange where it would align with the gasket magnet.

Accordingly, the illustrated refrigerated cabinet 10 is configured so that the door gasket 60 makes an outer seal with a metal section of the door frame 30 at the outer seal region SR1 and an inner seal with a plastic section the door frame at the inwardly spaced inner seal region SR2. The heating element duct 141 is spaced apart inward of the outer sealing region SR1 and outward of the inner sealing region SR2.

The inventors initially developed the above-described refrigerated cabinet 10 with an intent to improve manufacturability. In that regard, the inventors believe that the design has yielded substantial improvements. For example, the thermal breaker 116 is constructed from a simple and robust plastic extrusion. The door frame 30 is configured to magnetically adhere with the gasket 60 at the wrapper 112, without any other ferromagnetic materials being included. The door frame 30 is free of magnets and ferromagnetic metal strips, the inclusion of which adds substantial manufacturing complexity and cost to many prior art cabinet designs. Additionally, components of the cabinet body 12 couple together with relative ease and a high degree of safety. The double-return flange 120 of the wrapper 112 provides a smooth (non-sharp) surface for gripping during assembly, and the snap-in features 128 on the front edge margin of the liner 114 enable rapid fastening to the thermal breaker during assembly.

In addition to the notable benefits of the above-described refrigerated cabinet 10 in terms of manufacturability, the inventors surprisingly discovered substantial improvements in performance—particularly, mitigation against condensation at the door frame 30. The refrigerated cabinet 10 has been tested and found to prevent condensation from forming at the door frame 30 when the refrigeration system 16 maintains a −10° F. (−23° C.) set point in ambient conditions of at least 90° F. (32° C.) and at least 70% relative humidity without heating the door frame. Additionally, with a heating wire in the heating duct 141 operating at 1.7 W/ft (5.6 W/m), the refrigerated cabinet 10 was found to prevent condensation from forming at the door frame 30 when the refrigeration system maintains the −20° F. (−29° C.) set point in ambient conditions of at least 90° F. (32° C.) and at least 70% relative humidity. The inventors believe that this level of condensation mitigation performance has never been achieved in a refrigerated cabinet with a metal wrapper and foam insulation walls less than 3.0 inches (7.6 cm) thick.

Figure 11:
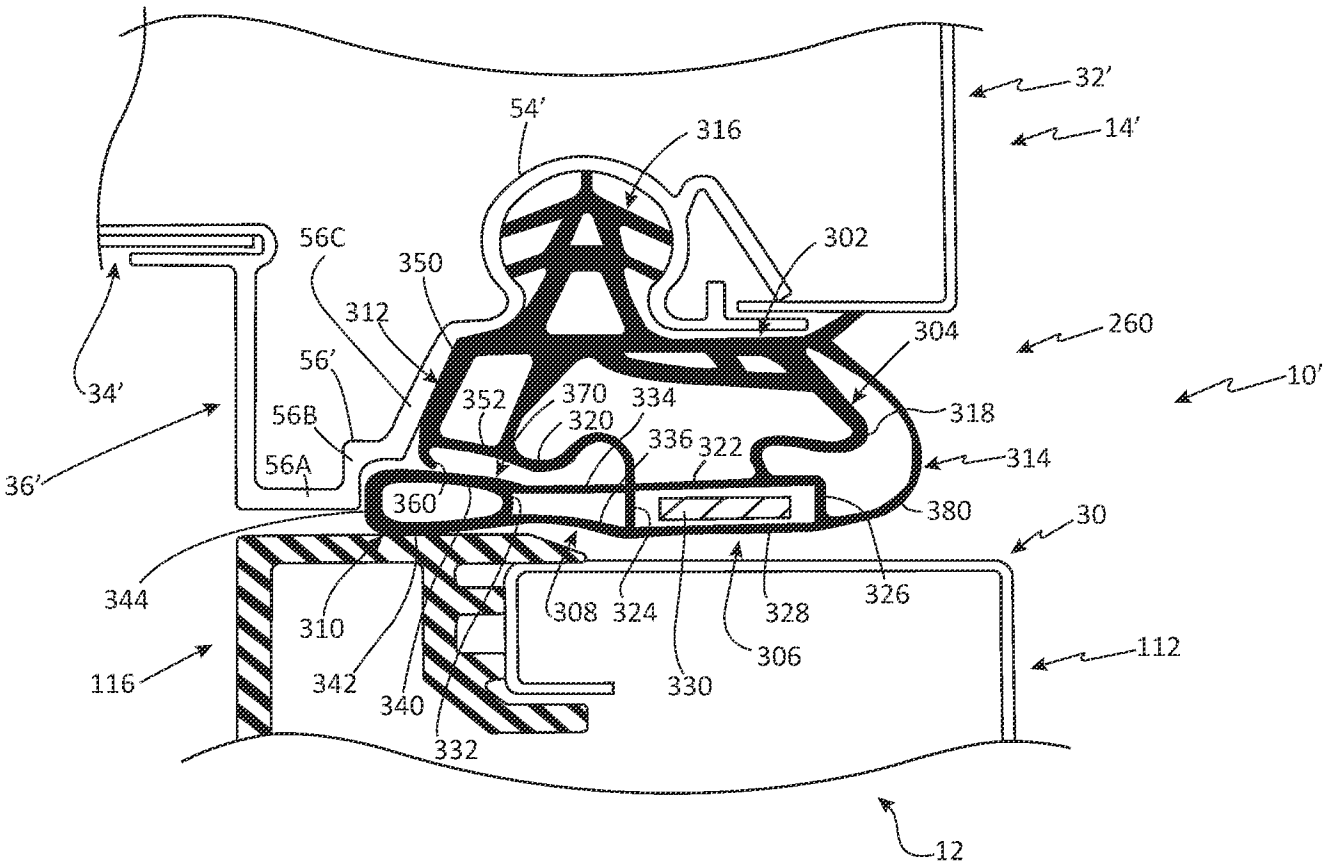
FIG. 11 is an enlarged fragmentary cross section view similar to FIG. 10 of another embodiment of a refrigerated cabinet.
Figure 12:
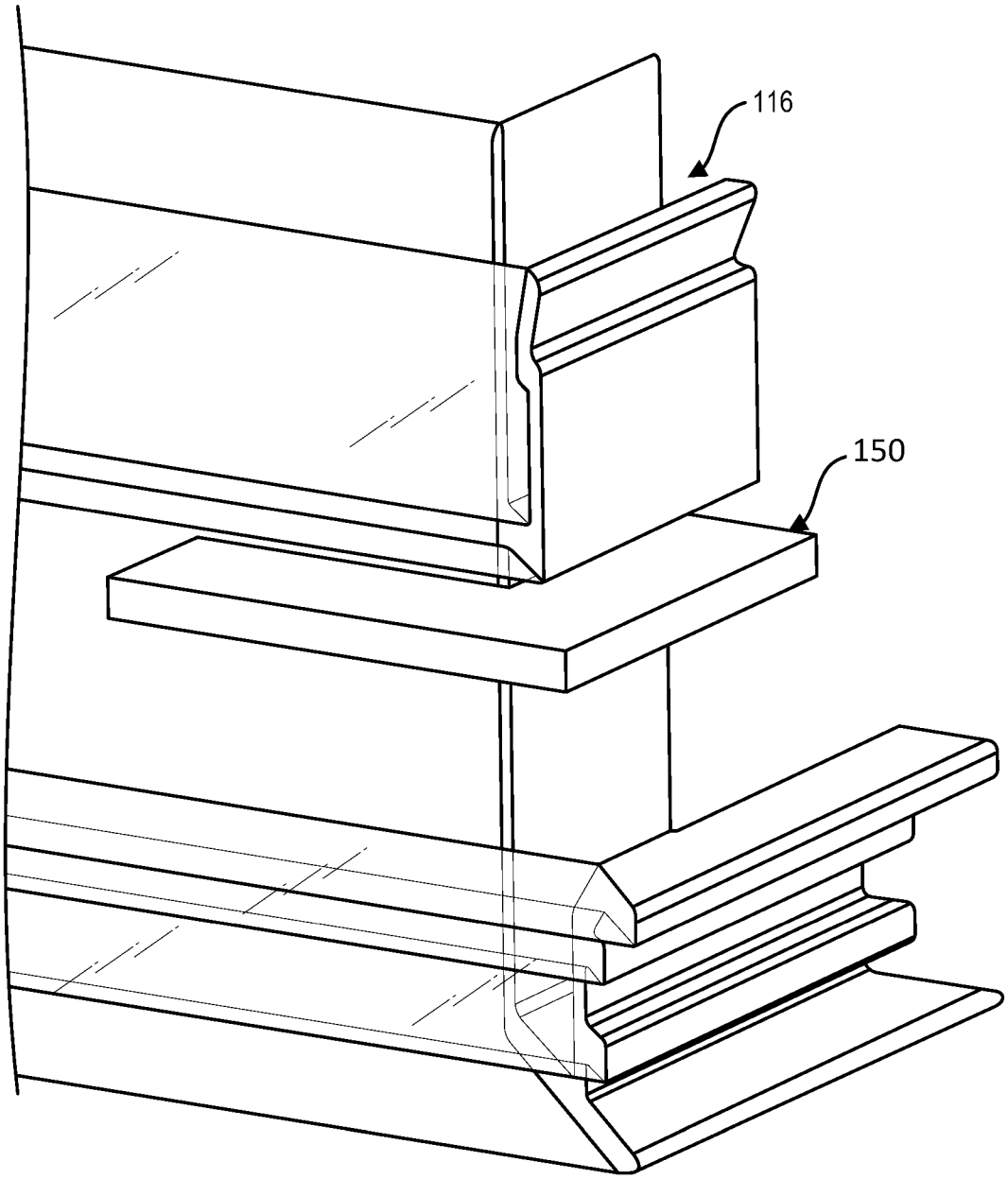
FIG. 12 is a fragmentary perspective of a corner joint of a thermal breaker of the refrigerated cabinet in which one thermal breaker piece is shown transparent and a corner joiner element is at an uninstalled position.
Figure 13:
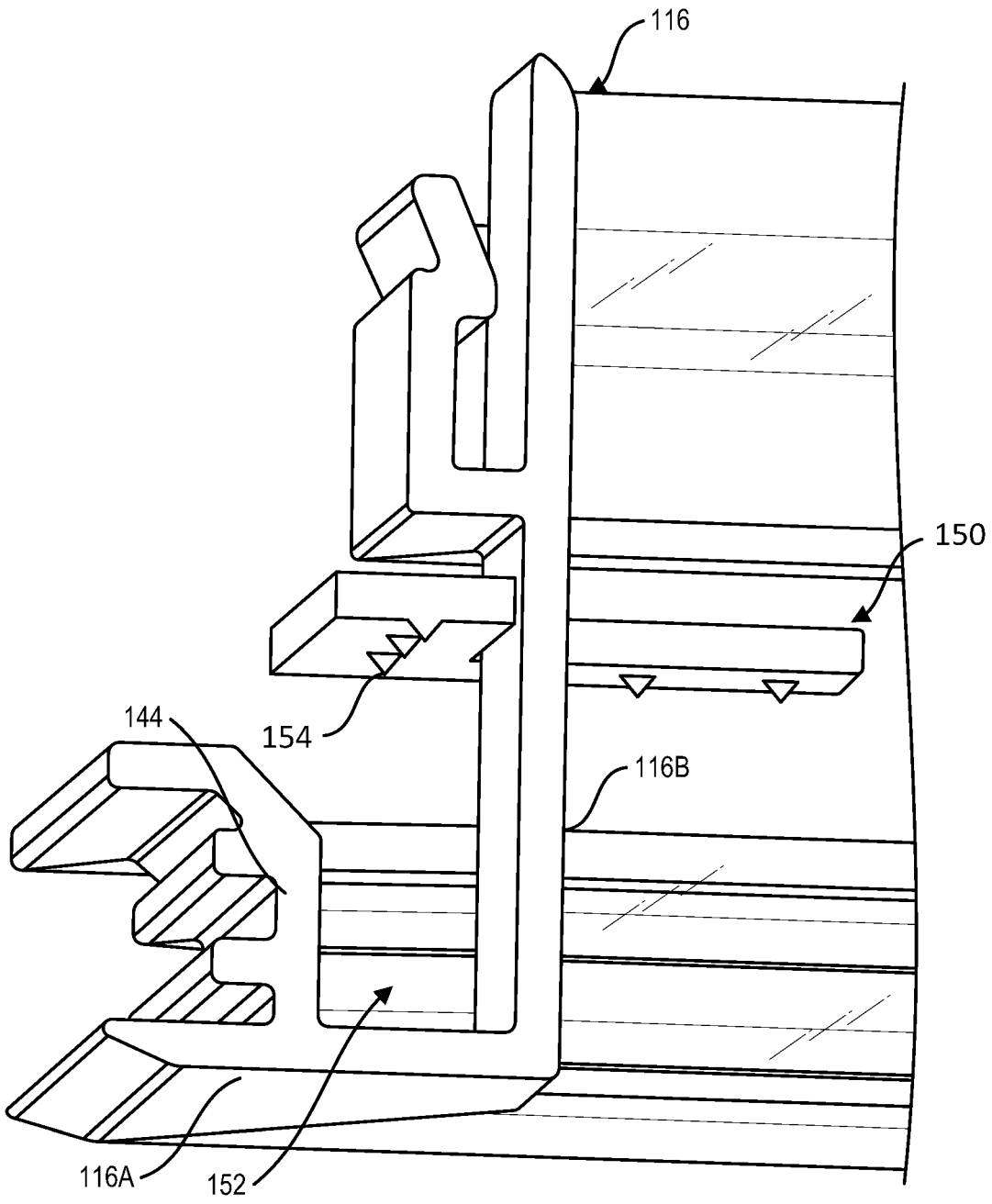
FIG. 13 is a cross sectional perspective of the corner joint showing the corner joiner element at the uninstalled position.
Figure 14:
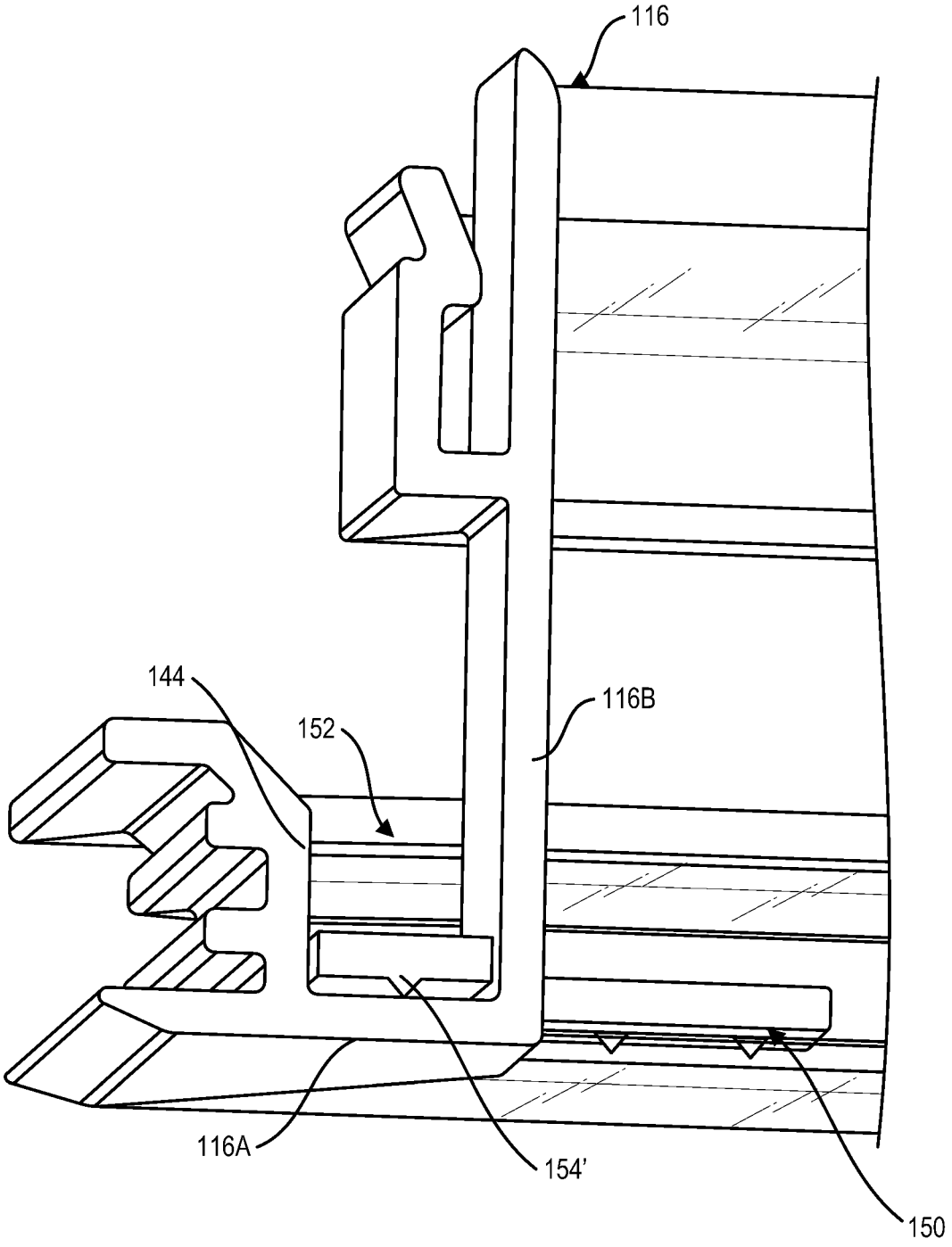
FIG. 14 is a cross sectional perspective similar to FIG. 13 but showing the corner joiner element at an engaged position for ultrasonic welding.
Figure 15:
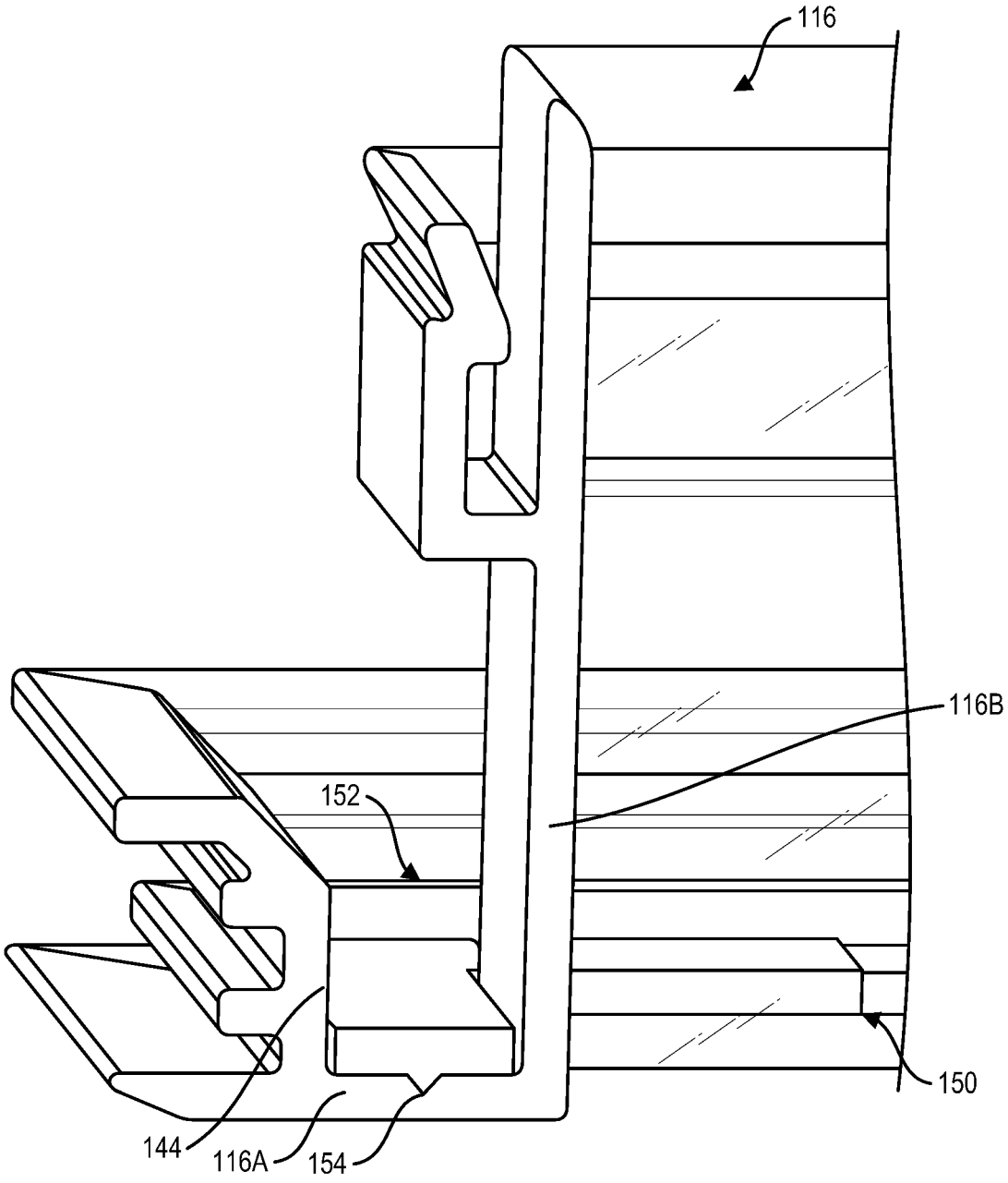
FIG. 15 is a cross sectional perspective similar to FIG. 13 showing the corner joint after the corner joiner element is welded to the thermal breaker.

Referring to FIG. 11, another embodiment a refrigerated cabinet in the scope of this disclosure is generally indicated at reference number 10'. Unless otherwise indicated, the refrigerated cabinet 10' has the same features as the refrigerated cabinet 10. The refrigerated cabinet 10' has the same cabinet body 12 as the refrigerated cabinet 10 but a modified door 14'. The door 14' has the same door wrapper 32 and door liner 34 as the door 14 but a modified door thermal breaker 36' configured to cooperate with a modified door gasket 260.

In cross section, the gasket 260 comprises a base 302, a bellows chamber 304, a magnet chamber 306, a middle chamber 308, a sealing bulb chamber 310, an inner support chamber 312, and an outer condensation shield chamber 314. In one or more embodiments, the gasket 260 is formed from one homogenous material (e.g., a plastic such as a PVC composition). For example, the gasket 260 can comprise four gasket sections—one for each side of the door—each gasket section being formed from a single-piece, single-material extrusion, and the four gasket sections can be joined together by welding at mitered corner joints.

The base 302 includes a main section that extends generally parallel to the major plane of the door 14'. The base 302 is formed from relatively thick material so that the base is relatively rigid. For example, sections of the gasket 260 forming the bellows chamber 304, sealing bulb chamber 310, and the condensation shield chamber 314 are preferably thinner and more flexible than the thicker base. A mounting dart 316 (broadly, a mounting feature) extends forward from the base to be snap-fit into a mounting channel 54' of the door 14'.

The bellows chamber 304 has a front end connected to the base 302 and an opposite rear end connected to the magnet chamber 306. The bellows chamber 304 is flexible and configured to extend and contract backward and forward. The bellows chamber comprises an inner bellows wall 318 and an outer bellows wall 320. Each of the inner bellows wall 320 and the outer bellows 318 wall has a rear end joined to a front wall 322 of the magnet chamber 306. Each bellows wall 318, 320 has a serpentine shape. The exteriors of both bellows walls 318, 320 include a front section that is externally convex and a rear section that is externally concave.

The magnet chamber 306 is supported on the rear end of the bellows chamber 304. The magnet chamber 306 is generally rectangular, with opposite inner and outer sides 324, 326 and a back side 328 opposite the aforementioned front side 322. The magnet chamber 306 is configured to receive a magnet 330. The magnet chamber 306 aligns the magnet 330 with the exposed front surface of the ferromagnetic metal wrapper 112 so that the magnet is configured to draw the magnet chamber into close, sealing contact with the wrapper at an outer sealing region when the door 14' is closed. As the magnet 330 draws the magnet chamber 306 toward the wrapper 112, the bellows chamber 304 is configured to extend rearward.

The middle chamber 308 and the sealing bulb chamber 310 collectively form a partitioned cantilevered arm that is cantilevered from the inner side 324 of the magnet chamber 306. The cantilevered arm is partitioned by a partition wall 332, forming an inner side of the middle chamber 308, opposite the inner side 324 of the magnet chamber. The middle chamber 308 has opposite front and rear sides 334, 336 extending from the inner side of the magnet chamber to the partition wall 332. Each of the front side 334 and the rear side 336 of the middle chamber 308 is joined to the magnet chamber 306 at a respective cantilevered joint. The front cantilevered joint is substantially even with the front side 322 of the magnet chamber in the front-to-back direction, and the rear cantilevered joint is substantially even with the rear side 328 of the magnet chamber in the front-to-back direction. The cantilevered arm is free of joints with any other part of the gasket. When the door 14' is closed, the middle chamber 308 is configured to engage the transition zone of the front face of the door frame 30 where the thermal breaker 116 interfaces with the wrapper 112. The magnet 306 draws the rear side 336 of the middle chamber 308 toward the front face of the door frame 30 to enhance the seal provided by the gasket 260.

The sealing bulb chamber 310 comprises a front side 340, a rear side 342 opposite the front side, and an inner side 344 opposite the partition 332. The inner side 332 of the sealing bulb chamber 310 forms the distal end of the cantilevered arm. Each of the front side 340 and the rear side 342 of the sealing bulb chamber 310 extends from the inner side 344 of the sealing bulb chamber to the inner side of the middle chamber and are free of joints to any other part of the gasket. The front sides 334, 340 of the middle chamber 308 and the sealing bulb chamber 310 form a contiguous front side of the cantilevered arm. The rear sides 336, 342 likewise form a contiguous rear side of the cantilevered arm.

The sealing bulb chamber 310 is configured to be compressed between the door frame 30 and the profiled section 56' of the door 14' when the door is closed. In the illustrated embodiment, the profiled section 56' of the door 14' comprises a rear segment 56A substantially parallel to the main plane of the door 14'. A bulb receptacle segment 56B curves forward and outward from the rear segment 56A to define an outward/backward facing contact surface configured to generally conform to the front/inner corner region of the sealing bulb chamber 310. The profiled section 56' further comprises a support wall segment 56C that extends forward at an outward angle from the bulb receptacle segment 56B to the mounting channel 54'. The support wall segment 56C is configured to supportively engage the inner support chamber 312 of the gasket 260. When the door 14' is closed, the sealing bulb 310 is compressed between the bulb receptacle segment 56B and the front face of the door fame 30 (e.g., the front face of the thermal breaker 116). In one or more embodiments, the sealing bulb chamber 310 contacts the profiled section 56' of the door along less than one-quarter of the circumference of the sealing bulb chamber when the door is closed.

The inner support chamber 312 is configured to be received between the bellows chamber 304 and the profiled section 56' of the door 14'. The inner support chamber 312 comprises an inner support wall 350 extending rearward from the base 302 to a rear end and a connecting web extending 352 from the rear end to the inner bellows wall 320. The inner support wall 350 is configured to engage the support wall segment 56C of the profiled section 56 along substantially its entire length. The inner bellows wall 320 and the connecting web 352 meet at a joint spaced apart along the inner bellows wall midway between the front and rear ends thereof. Suitably, the inner support wall 350 can be thicker than the connecting web 352. The inner support wall 350, the connecting web 352, the inner bellows wall 320, and the inner end portion of the base 302 collectively define the inner support chamber 312.

The gasket 260 further comprises at least one wiper 360 extending rearward from the inner support chamber 312 toward the sealing bulb chamber 310 (or more broadly, toward the cantilevered arm). When the door 14' is closed, the rear end of the wiper 360 contacts the sealing bulb chamber 310 at a location that is outwardly spaced from where the sealing bulb chamber contacts the bulb receptacle segment 56B of the profiled section 56' of the door 14' such that the wiper helps press the sealing bulb chamber backward against the door frame 30. As shown in FIG. 11, the contact of the tip of the wiper with the sealing bulb chamber 310 also enables the cantilevered arm, the bellows chamber 304, the inner support chamber 312, and the wiper 360 to collectively define an openable supplemental chamber 370 when the door is closed. Because of this supplemental chamber, the connecting web 352 is spaced apart in front of the cantilevered arm when the door is closed. The connecting web 352 is also generally parallel to the cantilevered arm when the door is closed.

In the illustrated embodiment the condensation shielding chamber 314 is partially defined by a condensation shield 380. The condensation shield 380 covers the outer bellows wall 318 and thereby shields the outer bellows wall from exposure to ambient atmosphere. The condensation shield 380 has a front end connected to the base 302, a rear end connected to the magnet chamber 306 (particularly, the back/outer corner of the magnet chamber), and a length extending from the front end to the rear end. The condensation shield 380 is preferably externally convex along the entire length. The inventors believe this can prevent ambient moisture from becoming trapped in concave recesses exposed to the ambient environment.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

As various changes could be made in the above products and methods without departing from the scope of the disclosure, it is intended that all matter contained in the above description shall be interpreted as illustrative and not in a limiting sense.

What is claimed is:

1. A gasket for a door of a refrigerated cabinet, the gasket comprising:

a base configured to be supported on the door along the perimeter edge margin of the door so that the gasket faces backward from the door for sealing with a door frame of the refrigerated cabinet when the door is closed;

a bellows chamber having a front end connected to the base and an opposite rear end;

a magnet chamber supported on the rear end of the bellows chamber, the magnet chamber having an inner side and an outer side;

a magnet received in the magnet chamber; and a cantilevered arm cantilevered from the inner side of the magnet chamber, the cantilevered arm including a proximal middle chamber, a distal sealing bulb chamber, and a partition wall between the middle chamber and the sealing bulb chamber.

2. The gasket as set forth in claim 1, wherein the bellows chamber comprises an inner bellows wall and an outer bellows wall, each of the inner bellows wall and the outer bellows wall having a rear end.

3. The gasket as set forth in claim 2, wherein the magnet chamber comprises a front side and a rear side, each of the front side and the rear side extending from the inner side to the outer side of the magnet chamber, the rear ends of the inner bellows wall and the outer bellows wall being joined to the front side of the magnet chamber.

4. The gasket as set forth in claim 3, wherein the middle chamber comprises a front side and a rear side opposite the front side, each of the front side and the rear side of the middle chamber extending from the inner side of the magnet chamber to the partition wall and being free of joints to any other part of the gasket.

5. The gasket as set forth in claim 4, wherein the sealing bulb chamber comprises a front side, a rear side opposite the front side, and an inner side, each of the front side and the rear side of the sealing bulb chamber extending from the inner side of the sealing bulb chamber to the partition wall and being free of joints to any other part of the gasket.

6. The gasket as set forth in claim 3, further comprising a condensation shield shielding the outer bellows wall from exposure to ambient atmosphere.

7. The gasket as set forth in claim 6, wherein the condensation shield defines a condensation shielding chamber outside of the outer bellows wall.

8. The gasket as set forth in claim 6, wherein the condensation shield has a front end connected to the base, a rear end connected to the magnet chamber, and a length extending from the front end to the rear end, the condensation shield being externally convex along the length.

9. The gasket as set forth in claim 2, further comprising an inner support chamber adjacent the bellows chamber, configured to be received between the bellows chamber and the profiled section of the door.

10. The gasket as set forth in claim 9, further comprising a wiper extending rearward from the inner support chamber toward the cantilevered arm.

11. The gasket as set forth in claim 10, wherein the sealing bulb chamber is configured to be pressed against the wiper when the door is closed such that the cantilevered arm, the bellows chamber, the inner support chamber, and the wiper define an openable supplemental chamber when the door is closed.

12. The gasket as set forth in claim 9, wherein the inner support chamber comprises an inner support wall extending rearward from the base to a rear end and a connecting web extending from the rear end to the inner bellows wall.

13. The gasket as set forth in claim 12, wherein the inner bellows wall and the connecting web meet at a joint spaced apart along the inner bellows wall from the rear end thereof.

14. The gasket as set forth in claim 13, wherein the connecting web is configured to be spaced apart in front of the cantilevered arm when the door is closed.

15. The gasket as set forth in claim 14, wherein the connecting web is generally parallel to the cantilevered arm when the door is closed.

16. The gasket as set forth in claim 12, wherein the inner support wall is thicker than the connecting web.

17. A gasket for a door of a refrigerated cabinet, the gasket comprising:

a base configured to be supported on the door;

a magnet chamber;

a magnet received in the magnet chamber;

the gasket having an inner side configured to face toward a refrigerated space when the door is closed and an outer side configured to face toward an ambient atmosphere when the door is closed, a bellows chamber connecting the magnet chamber to the base, the bellows chamber comprising an outer bellows wall having a front end connected to the base and a rear end connected to the magnet chamber; and a condensation shield spaced apart outwardly of the outer bellows wall and extending from the base to the magnet chamber for shielding the outer bellows wall from exposure to ambient atmosphere, wherein the condensation shield defines the outer side of the gasket.

18. A gasket for a door of a refrigerated cabinet, the gasket comprising a base configured to be supported on the door;

a bellows chamber having a front end connected to the base and an opposite rear end;

a magnet chamber supported on the rear end of the bellows chamber, the magnet chamber having an inner side and an outer side;

a magnet received in the magnet chamber;

a sealing bulb chamber cantilevered from the inner side of the magnet chamber, the sealing bulb chamber being configured to be compressed between a door frame of the refrigerated cabinet and a profiled section of the door when the door is closed;

an inner support chamber adjacent the bellows chamber configured to be received between the bellows chamber and the profiled section of the door; and a wiper extending forward from the inner support chamber;

wherein the sealing bulb chamber is configured to be pressed backward against the wiper such that the gasket defines a supplemental chamber when the door is closed, the wiper, the sealing bulb chamber, and the inner support chamber defining portions of the supplemental chamber.

19. The gasket as set forth in claim 18, wherein the bellows chamber comprises an inner bellows wall and an outer bellows wall, each of the inner bellows wall and the outer bellows wall having a serpentine shape including a front section that is externally convex and a rear section that is externally concave.

20. The gasket as set forth in claim 19, wherein the inner support chamber comprises an inner support wall and a connecting web extending from a rear end of the inner support wall to the front section of the inner bellows wall.

21. The gasket as set forth in claim 20, wherein the wiper extends rearward from the connecting web.

* * * * *